United States Patent [19]

Clark, Jr.

[11] 4,371,759

[45] Feb. 1, 1983

[54] ENCODING SWITCH

[75] Inventor: John T. Clark, Jr., Zion, Ill.

[73] Assignee: Cherry Electrical Products Corporation, Waukegan, Ill.

[21] Appl. No.: 223,116

[22] Filed: Jan. 7, 1981

[51] Int. Cl.[3] ..... H01H 9/26

[52] U.S. Cl. ..... 200/5 R; 200/153 LA; 200/159 A; 200/314

[58] Field of Search ..... 200/1 R, 5 R, 6 R, 17 R, 200/18, 159 R, 159 A, 314, 340, 1 A, 153 LA; 179/90 K; 235/92 BD, 439, 441; 340/365 C

[56] References Cited

U.S. PATENT DOCUMENTS

| | | | |
|---|---|---|---|
| 3,329,792 | 7/1967 | Jones et al. | 200/314 |
| 3,636,282 | 1/1972 | Kirchdorf | 200/159 A X |
| 3,846,605 | 11/1974 | Pirchl | 340/365 R X |
| 3,951,007 | 4/1976 | Naulin | 200/38 BA X |
| 4,109,119 | 8/1978 | Baelz et al. | 200/38 CA X |
| 4,317,968 | 3/1982 | Kuhfus | 200/5 R |

FOREIGN PATENT DOCUMENTS

| | | |
|---|---|---|
| 987591 | 3/1965 | United Kingdom . |
| 1012725 | 12/1965 | United Kingdom . |
| 1101018 | 1/1968 | United Kingdom . |
| 1375361 | 11/1974 | United Kingdom . |

OTHER PUBLICATIONS

Micro Switch Division of Honeywell, Product Brochure AML Issue 5, "AML The Advanced Manual Line from Microswitch", p. 8.

*Primary Examiner*—J. R. Scott

*Attorney, Agent, or Firm*—Hume, Clement, Brinks, Willian & Olds, Ltd.

[57] ABSTRACT

An encoding switch generates selected patterns of voltage signals that correspond to the binary bits of a code word. A base of the switch supports a plurality of pairs of terminals. Each pair of terminals includes a conducting stationary terminal and a conducting moveable terminal that is positioned adjacent to the stationary terminal. An encoding module is inserted over the base to define a particular pattern of voltage signals. The module has a plurality of selectively detachable tabs that engage the movable terminals and press the terminals against adjacent stationary terminals when the module is slidingly engaged with the body. Relatively long tabs of the module establish connections corresponding to the data bits of a word and at least one short tab establishes a power connection for the switch. As the module is inserted over the base, the longer tabs initially establish the connections that define the data bits and the shorter tab thereafter causes power to be applied to the switch so that a corresponding pattern of electrical signals is generated.

18 Claims, 7 Drawing Figures

ENCODING SWITCH

TECHNICAL FIELD

The invention relates to switches that generate selected patterns of electrical signals, for example binary coded decimal signals. More particularly, the invention relates to an encoding switch that generates signals in a pattern defined by a coding module which is inserted into the switch.

BACKGROUND OF THE INVENTION

Digital systems receive and transmit data in the form of digital words that are defined as patterns of binary bits. Such systems may employ switches to generate for example, binary coded decimal words that correspond to selected decimal numbers.

Rotary-type switches have been used to select particular coded words from a preset list of words. However, rotary switches generally do not have the capacity to generate signals for relatively large numbers of words. Also, it is generally difficult to change the code of an existing word of a rotary switch or to add a word to the list of words of the switch.

It has been determined that a code word may be readily modified if each bit of the word is defined by a separate switch. Thus, the switches may be operated to define any possible combination of bits for the word. However, the word selection process is relatively slow and is prone to operator error, since more than one switch must be operated to define a word. Also, the switches which define a single word usually take up a relatively large amount of space on an instrument panel.

The disadvantages of the above-indicated switches have been overcome in part by a commercially available encoding switch which employs cam modules to define digital words. In operation, a cam module is engaged with the body of the switch so that cam surfaces of fingers or tabs of the module press flexible terminals of the switch against associated stationary terminals and thereby define the bits of a word. The bits of the word may be changed by removing the associated cam module and inserting a new module which has a different pattern of cam surfaces.

Each digital word of the known cam-operated encoding switch is defined by a corresponding cam module which is manufactured with a particular pattern of cam surfaces. As the number of output bits of a switch is increased, the number of different cam modules for the switch also increases and the complexity and expense of the cam manufacturing process is likewise increased, since additional unique modules must be produced. Also, spare modules must be purchased and stored for every word of a switch, in order to ensure that a replacement module will be available if any operating module is lost or damaged.

The cam modules of the prior art encoding switch are marked to indicate the identity of the associated code words. However, if an identifying mark of a module is removed or obliterated, it may be somewhat difficult to identify the module's code by inspecting its cam surfaces. Thus, the relatively complex activating fingers of known cam modules do not appear to be particularly suitable for use in a simple, compact and relatively low cost encoding switch.

Accordingly, it is an object of the invention to provide a compact encoding switch which generates a relatively large number of coded bits, for example eight binary bits.

A further object of the invention is to provide an encoding switch that utilizes a single uniformly shaped encoding module which may be easily modified by a user to define the bits of a particular code word.

Another object of the invention is to provide an encoding switch with an encoding module that has a physical structure that is clearly representative of the coding operation of the module.

A further object of the invention is to provide a blank encoding module with frangible tabs that are selectively removed to define a desired code word for an encoding switch.

It will be appreciated by those skilled in the art that an encoding switch will not generate coded output signals until power is applied to the switch. Thus, an encoding module may be inserted into the body of an unpowered switch and thereafter, power may be applied to the switch to generate corresponding output signals.

In practice, it is expected that the body of an encoding switch will typically remain "plugged" into a powered printed circuit board when encoding modules are exchanged in the switch. Accordingly, it is possible that a powered switch will generate momentary random signals when a module is initially inserted, since the module will probably engage switch terminals in a random order. Such random signals are generally undesirable since they may interfere with the proper operation of a circuit that monitors the switch.

Accordingly, it is an object of the invention to provide an encoding switch with a body portion that remains powered and encoding modules that may be inserted into the powered body to define bit patterns, without generating undesirable random intermittent signals.

A further object of the invention is to provide an encoding switch with an encoding module that initially establishes data connections which define a particular code pattern and after the connections are established, makes a common power connection for the switch.

A light source may be placed within an encoding switch to illuminate the switch when coded signals are being generated, so that an operator has a positive indication of the operational condition of the switch. However, the light source may generate heat within the switch and the heat may cause engaged terminals within the switch to expand and to move out of contact with one another.

Thus, it is an object of the invention to provide a lighted encoding switch with an encoding module which maintains the connections of terminals within the switch when the switch is internally heated by a light source.

It is known that the reliability of an encoding switch may be reduced if dust particles within the switch interfere with conductive connections between terminals of the switch.

Accordingly, a further object of the invention is to provide an encoding switch wherein reliable switch connections are achieved by wiping switch terminals together.

SUMMARY OF THE INVENTION

In order to achieve the objects of the invention and to overcome the problems of the prior art, the encoding switch of the invention includes a switch body that supports a plurality of stationary terminals and adjacent moveable terminals that are deflected to conductively contact the stationary terminals.

An encoding module slidingly engages the body of the switch and defines a particular pattern of electrical signals when power is applied to the switch. The encoding module has a plurality of tabs that are each dimensioned to press a moveable terminal against its adjacent stationary terminal when the module is engaged with the body of the switch. A particular pattern of signals is defined by selectively removing tabs of the encoding module.

In a preferred embodiment of the encoding switch, the tabs that make the connections that define the bits of a code word are longer than a tab that establishes a power connection for the switch. Thus, the connections defining the bits of a code word are made before power is applied to the switch.

The encoding switch also includes a housing that holds the engaged encoding module and body of the switch. Each of the tabs of the encoding module has a raised ridge that engages an inside wall of the housing and thereby maintains the tab in contact with a moveable terminal, even if the tab expands in response to an increased temperature within the switch.

The body of the switch supports a light emitting diode or incandescent lamp that emits visible light when power is applied to the switch. The light source of the switch is supported in the body of the switch by upstanding retaining springs.

DETAILED DESCRIPTION OF PREFERRED EMBODIMENTS

Figure 1:
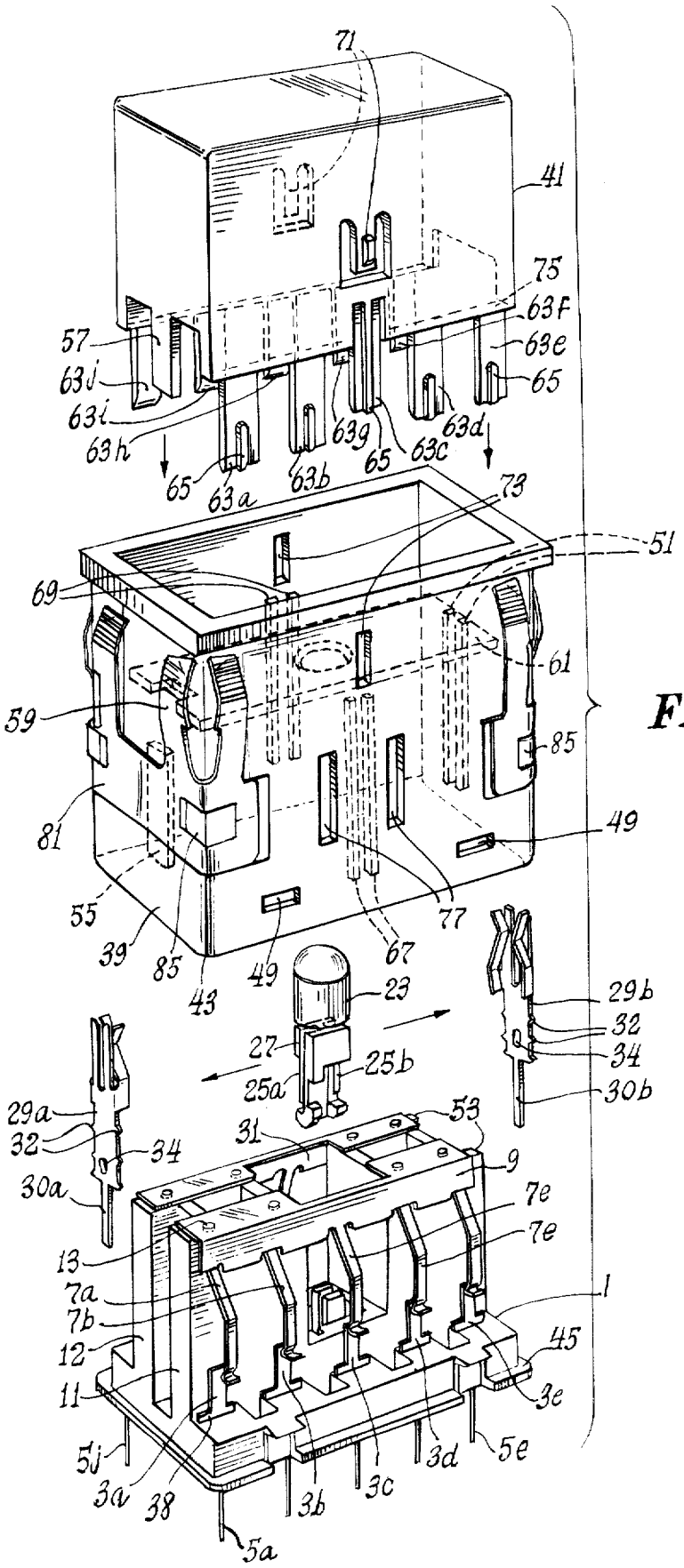
FIG. 1 illustrates an exploded view of the components of an encoding switch, in accordance with the invention.

The remaining portion of the specification will describe preferred embodiments of the invention when read in conjunction with the attached drawings, in which like reference characters designate identical apparatus.

FIG. 1 illustrates an exploded view of the components of an encoding switch, in accordance with the invention. One side of a base portion 1 of the switch supports five stationary terminals 3*a*, 3*b*, 3*c*, 3*d* and 3*e* that extend through the base of the body and form output pins 5*a*–5*e*. Five corresponding flexible terminals 7*a*, 7*b*, 7*c*, 7*d* and 7*e* extend from a common strip 9 that is affixed to an upstanding wall 11 of the base 1, for example by a stake rollover process whereby upstanding pegs 13 of the wall 11 are inserted through corresponding holes in the strip 9 and are then deformed radially outwardly by stamping to retain the strip 9.

The stationary terminals 3*a*–3*e*, the flexible terminals 7*a*–7*e* and the strip 9 are made of electrically conducting material. For example, the stationary terminals 3*a*–3*e* may be made of brass and the flexible terminals 7*a*–7*e* and terminal strip 9 may be made of bronze.

Figure 2:
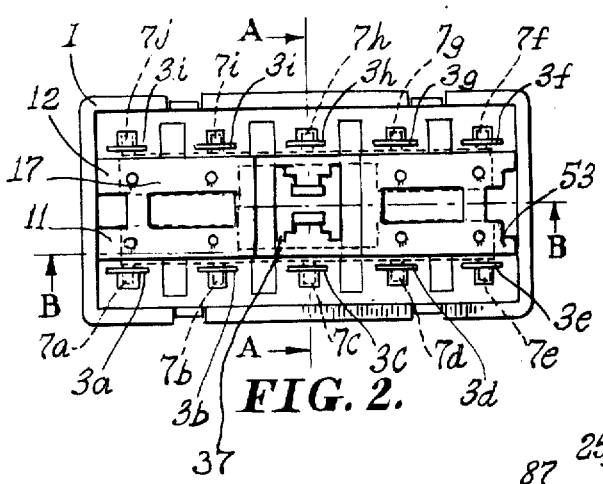
FIG. 2 illustrates a top elevation view of a base of the switch of FIG. 1.

FIG. 2 illustrates a top elevation view of the base 1, with the flexible terminals of the base shown in phantom for clarity. As shown in FIG. 2, the base 1 is symmetrical, with a wall 12 opposite the wall 11 supporting flexible terminals 7*f*–7*j* that extend from a common strip 17. Corresponding stationary terminals 3*f*–3*j* are embedded in the base and extend downwardly to form output pins. The common strip 17 is supported and retained on the wall 12 by the above-described stake rollover process.

As shown in FIG. 1, the encoding switch of the invention includes a light source 23, for example a light emitting diode (LED) or incandescent lamp, which has conducting terminal leads 25*a* and 25*b* that engage corresponding slots of a lamp mount 27. The lamp mount 27 is retained within a central portion of the base 1 by two electrically conducting retaining springs 29*a* and 29*b* that respectively contact the leads 25*a* and 25*b*.

Figure 3A:
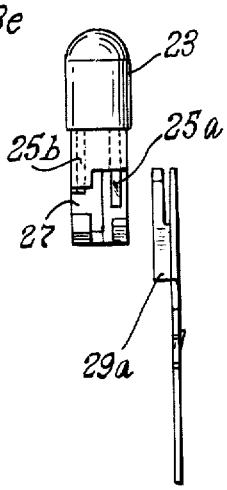
FIG. 3A illustrates a rear elevation view of the lamp mount and a disengaged retaining spring of the encoding switch of FIG. 1.
Figure 3B:
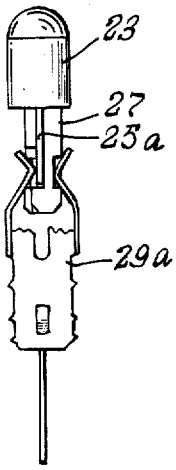
FIG. 3B illustrates a side elevation view of the lamp mount and an engaged retaining spring of the encoding switch of FIG. 1.

FIG. 3A shows a rear view of the lamp mount 27 of FIG. 1 and an associated disengaged retaining spring 29*a*. FIG. 3B shows a side view of the lamp mount 27 and engaged retaining spring 29*a*. In FIG. 3B a portion of the retaining spring has been cut away to show the conductive connection between the retaining spring and the terminal lead 25*a*. It should be understood that the other retaining spring 29*b* engages the opposite side of the mount to conductively contact the terminal 25*b*.

As shown in FIG. 1, the retaining springs 29*a* and 29*b* form input power pins 30*a* and 30*b* that connect to power supply points of a circuit board (not shown). The power pins apply energizing current to the light source 23 over the terminals 25*a* and 25*b*.

Figure 4:
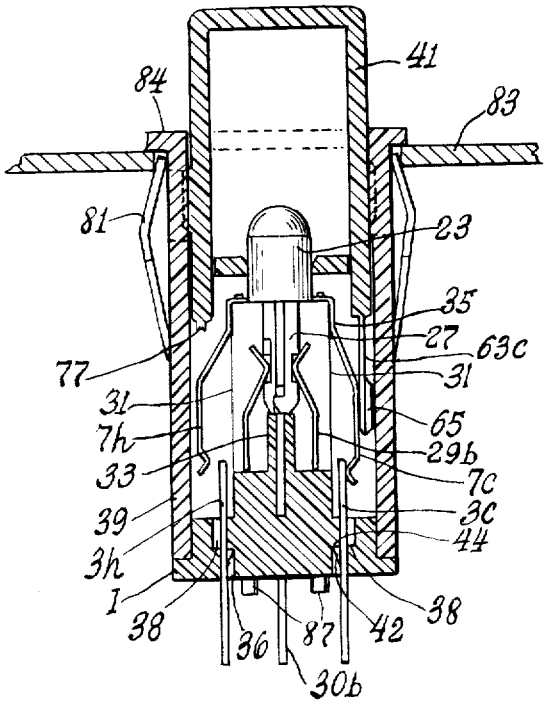
FIG. 4 illustrates a cross-sectional end elevation view of the assembled and mounted switch of FIG. 1, taken along the line A—A of FIG. 2.

FIG. 4 illustrates a cross-sectional side elevation view of an assembled switch, taken along the line A—A of FIG. 2. In assembling the switch, the power pin ends of the retaining springs 29*a* and 29*b* are inserted into associated elongated slots 37 of the base and the springs are pressed into the slots with a force that is sufficient to pierce a membrane 28 of base material which blocks each slot. A preferred thickness for each membrane is from 0.002 inches (0.00508 cm) to 0.005 inches (0.0127 cm). The pierced membranes prevent solder or other material from passing up the slots when the springs are seated in the base. If membranes are not used, other blocking material, for example glue, may be employed to seal the slots.

Figure 5:
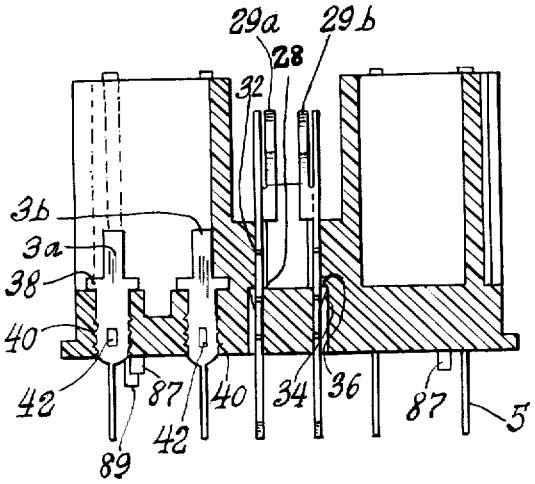
FIG. 5 illustrates a cross-sectional side elevation view of the base and lamp retaining springs of the encoding switch of FIG. 1, taken along the line B—B of FIG. 2.

As each retaining spring is pressed into its slot, barbs 32 at the edges of the spring cut into the base to anchor the spring at its rest position within the base. The springs are further locked at their rest positions by the operation of locking elements 34 that are shown in FIGS. 1 and 5. FIG. 5 is a cross-sectional side view of the base 1 taken along the line B—B of FIG. 2, with the flexible terminals removed for clarity of illustration.

Each locking element 34 is comprised of a raised area that is shear-formed on the body of a spring, for example by punching or stamping. As shown in FIG. 5, when a spring is pressed to its rest position in its slot 37, the top edge of the locking element 34 engages an inner ledge 36, which may be located at the same level as the blocking membrane of the slot. Thus, if either retaining spring is pushed upwardly, for example by inserting the power pin of the spring into a connector of a circuit board (not shown), the associated embedded barbs 32 and locking element 34 will resist upward movement.

In assembling the switch, the stationary terminals 3a–3j are pressed into corresponding elongated slots of the base 1 until shoulder portions 38 of the terminals block forward movement. The terminals are inserted into the terminal slots with a force that is sufficient to pierce inner blocking membranes 38 that are positioned within the slots to seal the slots in the manner described for the slots 37 of the retaining springs. The stationary terminals are locked at their rest or seated positions by barbs 40 and locking elements 42 that operate in the manner described for the barbs 32 and locking elements 34 of the retaining springs. More particularly, as shown in FIG. 4, the top edge of the locking element 42 of, for example the terminal 3C, engages an inner ledge 44 of the terminal slot. The ledge 44 may be located at the same level as the blocking membrane of the slot.

Figure 6:
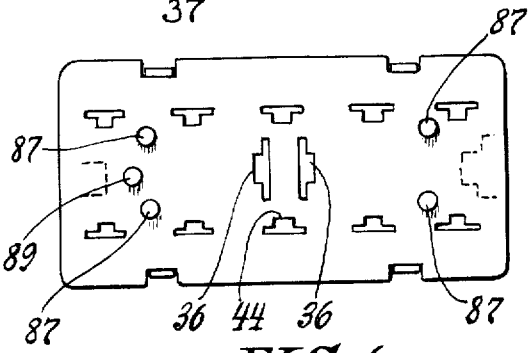
FIG. 6 illustrates a bottom view of the base of FIG. 2.

FIG. 6 illustrates a bottom view of the base of FIG. 2. As shown in FIG. 6, the inner ledge 36 for each retaining spring is displaced with respect to the slot 37, in order to engage the corresponding locking element 34. Likewise, the inner ledge 44 is displaced with respect to its terminal slot, in order to engage the locking element 42 of the associated stationary terminal.

In assembling the switch, the lamp mount 27 and engaged light source 23 are inserted into the base 1 so that the mount is supported on upstanding pedestals 33. As indicated above, the mount 27 is held in position by conducting retaining springs 29a and 29b that supply energizing current to the light source and that are supported in slots 37 of the base, so that the power pins 30a and 30b extend below the bottom of the base.

After the light source is mounted within the base, the base is inserted into a housing 39. An encoding module 41 is then inserted into the engaged base and housing. The module establishes particular connections between the flexible and stationary terminals of the base so that a coded signal is generated when power is applied to the base. The encoding module is constructed of transparent or translucent material that transmits the light of the light source 23. An identifying symbol may be inscribed on the face of the module to designate the coded signal that is defined by the module. Alternatively, the symbol may be printed on a transparent or translucent sheet which is glued to the face of the module.

As shown in FIGS. 1 and 4, the housing 39 is inserted over the base 1 so that the bottom edge 43 of the housing rests on a peripheral ledge 45 of the base and flexible locking tabs 47 of the base pass through corresponding locking apertures 49 of the housing to lock the base and housing together.

The base 1 is keyed into the housing 39 by parallel end rails 51 of the housing that slidingly engage corresponding L-shaped slots 53 at one end of the base and a single rail 55 that slides between the walls 11 and 12 at the other end of the base. It should be understood that the housing 39 may be inserted over the base 1 in only one orientation, since the rails 51 are spaced for insertion in the slots 53 rather than between the walls 11 and 12.

After the housing is engaged over the base 1, the encoding module 23 is engaged with the base by inserting the module into the housing 39 so that a keying tab 57 of the module passes through a slot 59 in a platform 61 of the housing and extending fingers or tabs 63a–63j pass through slots defined at the sides of the platform.

The encoding module is guided into the housing by the sliding engagement of an elongated ridge 65 of the tab 63c between guide rails 67 of the housing. A similar elongated ridge is formed on the tab 63h at the opposite side of the module and is slidingly engaged between associated guide rails 69. The module is locked in place by pressing the module into the housing until flexible tabs 71 on either side of the module snap into associated locking apertures 73 of the housing. The module may be removed from the housing by pulling upwardly on the module until the flexible tabs disengage from the locking apertures 73.

As the module 41 is pressed into the base 1, the tabs 63a–63j engage corresponding flexible terminals 7a–7j of the base and press the terminals against the stationary terminals 3a–3j. Particular patterns of terminal connections may be defined by tearing or breaking off selected tabs 63 of the encoding module 41, for example at the ledge 75, so that only the remaining tabs of the module engage associated flexible terminals.

In the switch of FIG. 4, the tab 63h has been detached at a point generally designated 77 so that the flexible terminal 7h does not contact its adjacent stationary terminal 3h. However, the tab 63c presses the terminal 7c against the terminal 3c.

In general, it should be understood that as a tab is pressed downwardly against its flexible terminal, the terminal is flexed in an arc downwardly and inwardly, so that the flexible terminal is wiped against its adjacent stationary terminal. The wiping action of the terminals ensures that a good conductive contact will be made, even if dust or other small insulating particles cover the terminals.

It is known that an energized light source of a switch will heat the interior of the switch so that closed terminals within the switch will tend to expand outwardly out of contact with one another. In the switch of FIG. 1, vent slots 77 are provided in two opposite walls of the housing 39 so that air may circulate through the switch to cool the interior of the switch. Also, the tabs 63a–63j of the encoding module have raised ridges 65 that press against an adjacent inside wall of the housing 39 when the module is engaged with the base. Thus, even if the tabs tend to expand in response to the heat of the light source, the walls of the housing will hold the tabs in contact with corresponding engaged terminals.

FIGS. 1 and 4 illustrate mounting brackets 81 that are employed to wedge the housing 39 of the switch within an aperture of an instrument panel 83. The mounting brackets are disposed within channels that are formed in the outer surface of the housing and are held in place by their pressing engagement with rectangular pegs 85 that are formed in the housing. In operation, the engaged housing and base are inserted into an aperture of the panel 83 until a top flange 84 of the housing stops at the edge of the aperture. Scored ends of the mounting brackets then press against the edges of the aperture of the panel to hold the switch in position.

FIGS. 4, 5 and 6 show stand-off pegs 87 that are employed to support the bottom surface of the base 1 in a spaced relation to a circuit board (not shown) that engages the output pins 5 of the switch. A locating peg 89 is provided for insertion into a corresponding locating aperture of the circuit board, in order to align the base with respect to the circuit board.

The above-described encoder module may be "programmed" to define any desired pattern of eight binary bits by removing selected tabs 63. Thus, the encoding switch of FIGS. 1-5 may be operated to provide up to two hundred fifty six identifiable codes, with each code corresponding to a unique pattern of eight binary bits.

In operation, the output pins 5 of the base 1 of the switch are plugged into a circuit board in a manner known to the art. More particularly, the output pins of the middle stationary terminals 3*c* and 3*h* of the base 1 are connected to receive an energizing voltage at power input points of the circuit board and the remaining output pins of the terminals 3*a*, 3*b*, 3*d*-3*g*, 3*i* and 3*j* are connected through the circuit board to whatever circuitry is required to monitor the digital word that is generated by switch.

The encoding module 41 of FIG. 1 has eight relatively long data tabs 63*a*, 63*b*, 63*d*-63*g*, 63*i* and 63*j* and two relatively short center power tabs 63*c* and 63*h*. As the module is inserted over the switch base 1, the eight long data tabs initially engage corresponding flexible terminals 7*a*, 7*b*, 7*d*-7*g*, 7*i* and 7*j* and press the flexible terminals against associated adjacent stationary terminals 3*a*, 3*b*, 3*d*-3*g*, 3*i* and 3*j*. However, the power tabs do not initially engage their associated flexible terminals 7*c* and 7*h*, since the power tabs are shorter than the data tabs. As the module 41 is further inserted to fully engage the base 1, the power tabs 63*c* and 63*h* press their flexible terminals 7*c* and 7*h* against the stationary power terminals 3*c* and 3*h* so that an energizing voltage is applied to the terminals 7*c* and 7*h*.

The energizing voltage at 7*c* and 7*h* is applied to all of the flexible terminals of the switch through the terminal strips 9 and 17 and the voltage is further applied to every stationary terminal that is conductively connected to a flexible terminal. Thus, when the encoding module is fully engaged with the base 1, a bit pattern of voltage signals is established at the output pins of stationary terminals 3*a*, 3*b*, 3*d*-3*g*, 3*i* and 3*j*. It should be understood that the switch will not generate random signals when the encoding module initially engages the base, since the connections that define the bit pattern are established before power is applied to the terminals 7*c* and 7*h*.

It should be understood that an encoding module with all of its tabs 63 may be modified to generate any desired eight bit code if selected tabs are removed. If a data tab is removed from an encoding module and the module is inserted over the switch base 1, a corresponding flexible terminal will not be pressed against its adjacent stationary terminal. Therefore, a voltage will not be applied to the stationary terminal and the terminal will register for example, a binary zero. On the other hand, if the tab is left in place, a voltage will be applied at the corresponding stationary terminal to indicate a binary one. It should be understood that the code that is defined by a particular module may be easily determined by an inspection of the module, since the presence of a tab 63 will designate a binary one and the absence of a tab will designate a binary zero.

The switch of FIG. 1 may be altered to provide a nine bit data word if the common terminal strips 9 and 17 are conductively connected and only one stationary terminal and associated flexible terminal is employed to supply power to the switch. It will be appreciated by those skilled in the art that if the switch is connected to generate a 9 bit word, the switch will provide up to five hundred twelve separate codes.

Although a preferred embodiment of the invention has been described with respect to two centrally located power pins and associated stationary terminals 3*c* and 3*h*, it should be appreciated that any of the pins of the switch may be employed to supply power to the switch in the above-described fashion. Also, it should be appreciated that other power connections may be employed. For example, the switch may be connected such that an open circuit between a flexible terminal and its associated stationary terminal will cause a voltage to be applied at the stationary terminal, while a closed connection will cause the signal at the stationary terminal to be pulled to ground. Moreover, the switch of FIG. 1 may be operated to generate a ten bit word if power is supplied to the common terminal strips 9 and 17 of the switch by means other than an input pin of the switch. For example, a power wire may be conductively connected to the terminal strips to provide the required power connection.

It should be appreciated that if it is desired to connect power at the same time as data connections are made for the switch, the power tabs 63*c* and 63*h* may be made the same length as the tabs 63*a*, 63*b*, 63*d*-63*g*, 63*i* and 63*j*. Also, the encoding switch of the invention may be constructed to provide more or less than ten tabs and associated pairs of flexible and stationary terminals.

The invention may be embodied in other specific forms without departing from its spirit or essential characteristics. The present embodiments are, therefore, to be considered in all respects as illustrative and not restrictive, the scope of the invention being indicated by the claims rather than by the foregoing description. Accordingly, all changes which come within the meaning and range of the equivalents of the claims are intended to be embraced therein.

I claim:

1. An encoding switch for generating signals corresponding to the binary bits of a code word, comprising:

base means for supporting a plurality of pairs of terminals, each pair of terminals including a conducting stationary terminal and a conducting movable terminal positioned adjacent said stationary terminal for deflecting to conductively contact the stationary terminal; and encoding means for slidingly engaging said base means to generate said signals for a particular code word, the encoding means including a plurality of selectively detachable tabs, each tab for pressing a corresponding movable terminal into conductive contact with its associated adjacent stationary terminal when the encoding means is slidingly engaged with the base means.

2. The encoding switch of claim 1 wherein at least one of the tabs is shorter than the other tabs so that the one shorter tab engages its movable terminal after the other longer tabs engage their movable terminals.

3. The encoding switch of claim 2 including means for applying electrical power to the conductive terminal connections established by said other tabs when said one shorter tab presses its movable terminal against an associated adjacent stationary terminal.

4. The encoding switch of claim 2 including means for conductively connecting the movable terminal engaged by said at least one shorter tab with movable terminals adjacent to other longer tabs.

5. The encoding switch of claim 1 further including a housing for covering said base means and for guiding said encoding means into sliding engagement with the base means in only one orientation with respect to the base means, and wherein the tabs of the encoding means each have a raised ridge for engaging an adjacent inside wall of the housing to maintain the tab in pressing contact with an adjacent movable terminal.

6. The encoding switch of claim 5 further including means for slidingly engaging said housing in only one orientation with respect to said base means.

7. The encoding switch of claim 1 further including source means for emitting light and means for detachably supporting the source means within the base means to illuminate the encoding means.

8. The encoding switch of claim 7 wherein said means for detachably supporting includes upstanding springs for holding said source means and applying energizing current to the source means.

9. The encoding switch of claim 1 further including a housing for supporting said base means and said encoding means and bracket means affixed to said housing for supporting the housing within an aperture of an instrument panel.

10. An encoding switch for generating selected patterns of voltage signals, comprising:

a plurality of stationary data output terminals;

at least one stationary power terminal and means for connecting the terminal to receive an energizing voltage;

a plurality of movable input terminals, each input terminal positioned adjacent an output terminal and having means for deflecting to conductively contact the adjacent output terminal;

at least one common movable terminal and means for conductively connecting the common movable terminal to a plurality of said movable input terminals, said common movable terminal having means for deflecting to conductively contact the stationary power terminal;

coder means having at least one detachable power terminal actuating tab and a plurality of detachable input terminal actuating tabs, each input terminal actuating tab for slidingly engaging and pressing a corresponding movable input terminal into conductive contact with its adjacent stationary output terminal and the power terminal actuating tab for slidingly engaging and pressing said common movable terminal into conductive contact with the stationary power terminal; and means for selectively detaching input terminal actuating tabs to define a corresponding selected pattern of electrical signals.

11. The encoding switch of claim 10 wherein each of the movable terminals includes means for wiping against an adjacent stationary terminal in response to a sliding pressure of an actuating tab.

12. The encoding switch of claim 10 wherein said at least one detachable power terminal actuating tab is shorter than each of the detachable input terminal actuating tabs.

13. The encoding switch of claim 10 including eight stationary output terminals, eight movable input terminals, two stationary power terminals, two common movable terminals and means for conductively connecting four movable input terminals to one common movable terminal and four other movable input terminals to the other common movable terminal.

14. An encoding apparatus, comprising:

base means for supporting a plurality of pairs of terminals, each pair of terminals including an electrically conducting stationary terminal and an electrically conducting movable terminal positioned adjacent to the stationary terminal for deflecting inwardly to conductively contact the stationary terminal and for deflecting outwardly to break contact with the stationary terminal;

housing means for engaging and retaining said base means;

a coding module for slidingly engaging said base means in said housing means to define particular switch states for said pairs of terminals, the coding module having a body portion and a plurality of selectively detachable tabs, each tab when attached to the body portion having means for slidingly engaging said housing means and means for deflecting an associated movable terminal inwardly into conductive contact with an adjacent stationary terminal, each tab when detached allowing its associated movable terminal to maintain a position in spaced relation to the adjacent stationary terminal;

at least one of said tabs being shorter than the other tabs, said shorter tab causing its associated pair of terminals to conductively contact one another at a time that is delayed with respect to the time at which the longer tabs cause their respective pairs of terminals to conductively contact each other.

15. The encoding apparatus of claim 14, wherein said means for slidingly engaging includes a raised ridge portion of a tab for holding the tab in an engaged relation with a movable terminal.

16. The encoding apparatus of claim 14, including means for connecting electrical power to the terminal pairs of said longer tabs when said at least one shorter tab causes the terminals of its terminal pair to conductively contact each other.

17. The encoding apparatus of claim 14, wherein said coding module includes means for displaying a symbol representative of the particular switch states defined by the tabs of the coding module.

18. The encoding apparatus of claim 14, further including a keying tab for defining a particular orientation for engaging the coding module with the housing means and base means.

* * * * *